US010814162B2

(12) United States Patent
Han

(10) Patent No.: US 10,814,162 B2
(45) Date of Patent: Oct. 27, 2020

(54) EXERCISE EQUIPMENT FOR STRENGTHENING PELVIS

(71) Applicant: Changkweon Han, Seoul (KR)

(72) Inventor: Changkweon Han, Seoul (KR)

( * ) Notice: Subject to any disclaimer, the term of this patent is extended or adjusted under 35 U.S.C. 154(b) by 50 days.

(21) Appl. No.: 16/203,766

(22) Filed: Nov. 29, 2018

(65) Prior Publication Data

US 2019/0168068 A1 Jun. 6, 2019

(30) Foreign Application Priority Data

Dec. 6, 2017 (KR) ..... 20-2017-0006276 U

(51) Int. Cl.
*A63B 23/02* (2006.01)
*A63B 21/16* (2006.01)
(Continued)

(52) U.S. Cl.
CPC ..... *A63B 23/0216* (2013.01); *A63B 1/00* (2013.01); *A63B 21/00047* (2013.01);
(Continued)

(58) Field of Classification Search
CPC ..... A63B 21/00058; A63B 21/00061; A63B 21/00065; A63B 21/00072; A63B 21/00185; A63B 21/00178; A63B 21/16; A63B 21/1609; A63B 21/1672; A63B 21/1681; A63B 21/4009; A63B 21/4011; A63B 21/4013; A63B 21/4015; A63B 21/4027; A63B 21/4033; A63B 21/4034;
(Continued)

(56) References Cited

U.S. PATENT DOCUMENTS 5,224,924 A * 7/1993 Urso ..... A61F 5/024 135/71
6,254,517 B1 * 7/2001 Kennedy ..... A63B 21/04 482/121
(Continued)

FOREIGN PATENT DOCUMENTS

JP 3959504 B2 8/2007
KR 10-2008-0019041 A 2/2008
KR 10-1665054 B1 10/2016

*Primary Examiner* — Loan B Jiminez
*Assistant Examiner* — Zachary T Moore
(74) *Attorney, Agent, or Firm* — KORUS Patent, LLC; Seong Il Jeong

(57) ABSTRACT

Disclosed herein is exercise equipment for strengthening the pelvis, by which the exercise effect of enabling the pelvis, the genitourinary sphincter inside the pelvic cavity, etc. to be strongly contacted and relaxed may be obtained during the exercise of collecting and spreading the knees. The exercise equipment includes: grip parts (110); cylindrical insertion/separation pipes (120); cylindrical support pipes (130); packing parts (140); cylindrical cushion parts (150); side fastening U-shaped plates (160); fastening plate supports (170); a side support connection bar (180); and fastening belts (200). Rotating grips (190) are attached to the bottoms of coupling bolts (B), respectively, by which the side support connection bar (180) connects and fastens the side fastening U-shaped plate supports (170), and the side support connection bar (180) is fastened to the bottom of the cushion part of a chair by using the two fastening belts (200) and coupling bolts (B').

1 Claim, 5 Drawing Sheets

(51) Int. Cl.
*A63B 21/00* (2006.01)
*A63B 1/00* (2006.01)

(52) U.S. Cl.
CPC ..... *A63B 21/1609* (2015.10); *A63B 21/4039* (2015.10); *A63B 2208/0233* (2013.01)

(58) Field of Classification Search
CPC ..... A63B 21/4035; A63B 21/4037; A63B 21/4039; A63B 21/4045; A63B 21/4047; A63B 21/4049; A63B 22/0015; A63B 22/0017; A63B 22/0025; A63B 22/0028; A63B 22/0046; A63B 22/0048; A63B 22/0056; A63B 22/0058; A63B 22/0064; A63B 22/0066; A63B 2022/003; A63B 23/02; A63B 23/0205; A63B 23/2016; A63B 23/0222; A63B 23/0227; A63B 23/035; A63B 23/03508; A63B 23/0355; A63B 23/03516; A63B 23/03533; A63B 23/03541; A63B 23/04; A63B 23/0482; A63B 23/0488; A63B 2023/006; A47C 9/002
See application file for complete search history.

(56) References Cited

U.S. PATENT DOCUMENTS 6,461,283 B1 * 10/2002 Maron ..... A63B 21/023 482/123
2005/0107225 A1 * 5/2005 Diamond, Jr. ..... A63B 23/0211 482/105

* cited by examiner

EXERCISE EQUIPMENT FOR STRENGTHENING PELVIS

CROSS-REFERENCE TO RELATED APPLICATION

This application claims the benefit of Korean Patent Application No. 20-2017-0006276 filed on Dec. 6, 2017, which is hereby incorporated by reference herein in its entirety.

BACKGROUND

1. Technical Field

The present invention relates generally to exercise equipment for strengthening the pelvis, by which the exercise effect of enabling the pelvis, the genitourinary sphincter inside the pelvic cavity, etc. to be strongly contacted and relaxed may be obtained during the exercise of collecting and spreading the knees, and more specifically to exercise equipment for strengthening the pelvis, in which the heights of respective insertion/separation pipes on which cylindrical cushion parts are installed may be easily and conveniently adjusted in accordance with the lengths of the legs of an exercising person, the cylindrical cushion parts on which the legs of a human body are placed are inclined forward at a predetermined angle so that the exercising person may perform the exercise of collecting and spreading the knees in a comfortable state in which the legs have been spread at a predetermined angle, and the exercise equipment for strengthening the pelvis is divided into left and right parts so that the assembly and disassembly of the exercise equipment may be easily performed, so that the exercise equipment may be conveniently installed and removed, and so that the carrying and storage of the exercise equipment may be conveniently and easily performed.

2. Description of the Related Art

Generally, health is the most essential life goal that everyone seeks, and it is desirable to perform continuous and beneficial exercise to maintain such a healthy life. Through exercise, strength can be improved, and also vitality in life can be boosted. In particular, in the case of a white-collar worker who lacks in the exercise of his or her lower body, it is important to correct the pelvis below the spine during exercise. The reason for this is that exercise in a state in which the pelvis below the spine has been twisted may exert burden on the spine and may thus cause a herniated disk.

Meanwhile, pelvic exercise equipment for preventing prostatitis, which is helpful in preventing prostatitis by strengthening the pelvis and increasing the muscular strength of a waist through the repeated stretching of collecting and spreading the knees of both legs inward and outward while straightening the waist in a sitting position in a state in which the pelvic exercise equipment has been put on a chair is disclosed in Korean Patent Application Publication No. 10-2008-0019041 (published on Feb. 29, 2008).

As shown in FIG. 1, the pelvic exercise equipment is configured such that a V-shaped coil spring 4 is fitted around a support 3 provided inside a case 2, ring members 5 are fitted over the two elastic rods 4-1 of the V-shaped coil spring 4, the ring members 5 are installed in an elliptical hole 2-1 formed through the front surface of the case 2, and physical strength plates 6 are coupled and fastened to the outer ends of the elastic rods 4-1, extended out of the case 2, by fasteners 6-1 to come into tight contact with the knees of both legs.

Accordingly, the pelvic exercise equipment strengthens the muscular force of the pelvis and the waist or lower abdomen through the repeated stretching of collecting and spreading the knees of both legs inward and outward while straightening the waist in a sitting position and bringing the knees of the legs into tight contact with the physical strength plates 6 in a state in which the case 2 has been put on a chair currently used, thus being helpful in preventing prostatitis.

However, the pelvic exercise equipment is disadvantageous in that it performs the simple stretching operation of moving the lower abdomen of a human body through the simple action of collecting and spreading the knees of both legs inward and outward by means of the tensile force of the coil spring 4 after an exercising person has brought his or her buttocks into tight contact with the case 2 and also has brought the knees of the legs into tight contact with the physical strength plates 6 and thus it does not obtain the exercise effect of enabling the pelvis and the sphincter to be strongly contacted.

Furthermore, the physical strength plates 6 with which the knees come into tight contact are easily separated from the elastic rods 4-1 of the coil spring 4, and thus a serious problem occurs in that the exercise of the legs may not be appropriately performed.

SUMMARY

The present invention has been conceived to overcome the above-described problems, and an object of the present invention is to provide exercise equipment for strengthening the pelvis, in which the exercise effect of enabling the pelvis, the genitourinary sphincter inside the pelvic cavity, etc. to be strongly contacted and relaxed may be obtained through the simple operation of moving the knees of both legs in vertical and lateral directions in a state in which an exercising person has placed his or her legs on respective cylindrical cushion parts installed on respective sides below grip parts while holding the grip parts provided above cylindrical insertion/separation pipes during the exercise of collecting and spreading the knees, the heights of the respective insertion/separation pipes on which the cylindrical cushion parts are installed may be easily and conveniently adjusted in accordance with the lengths of the legs of the exercising person, the cylindrical cushion parts on which the legs of a human body are placed are inclined forward at a predetermined angle so that the exercising person may perform the exercise of collecting and spreading the knees in a comfortable state in which the legs have been spread at a predetermined angle, and the exercise equipment for strengthening the pelvis is divided into left and right parts so that the assembly and disassembly of the exercise equipment may be easily performed, so that the carrying and storage of the exercise equipment may be conveniently and easily performed, and so that the exercise equipment may be conveniently installed and used on the cushion part of a chair in a home or office by using the fastening belts.

In order to accomplish the above object, the present invention provides exercise equipment for strengthening the pelvis, the exercise equipment including: grip parts (110) which are provided in the top portions of the exercise equipment; cylindrical insertion/separation pipes (120) which are connected to and extended downward from the grip parts (110), respectively; cylindrical support pipes (130) in which respective cylindrical spaces are formed so that the cylindrical insertion/separation pipes (120) are inserted thereto and separated therefrom, respectively, and each of which is provided with a plurality of holes on one side thereof so that protrusions (132), which elastically protrude from one side of a corresponding one of the insertion/separation pipes (120), are selectively coupled and fastened into the holes and thus enable the vertical adjustment of a length; packing parts (140) which are located along the axes of the support pipes (130), respectively, and which come into tight contact with and fasten the insertion/separation pipes (120), respectively; cylindrical cushion parts (150) each of which is inclined forward at a predetermined angle θ on one side of a corresponding one of the cylindrical insertion/separation pipes (120) below a corresponding one of the grip parts (110), in which a cushion support plate (152) is attached to one side end of each of support shafts (151) connected to the insertion/separation pipes (120), respectively, and which are attached around the support shafts (151) so that the legs of an exercising person are located and rotated thereon; side fastening U-shaped plates (160) in each of which a support shaft (161), to which a corresponding one of the cylindrical support pipes (130) is coupled, and upper and lower stop shafts (162 and 163), which are installed across upper and lower sides behind the support shaft (161), are formed, and in each of which a space, within which the angle of the cylindrical support pipe (130) is adjusted between the upper and lower stop shafts (162 and 163) around the shaft (161) in vertical and lateral directions, is formed; fastening plate supports (170) on which the bottom ends of the side fastening U-shaped plates (160) are installed, respectively; a side support connection bar (180) one side of which is coupled and fastened to an end of a corresponding one of the fastening plate supports (170), on which a corresponding one of the side fastening U-shaped plates (160) is installed, by a coupling bolt (B), which laterally extends in a horizontal direction, and a remaining side of which is coupled and fastened to a remaining one of the fastening plate supports (170), on which a remaining one of the side fastening U-shaped plates (160) is installed so that the angle of a corresponding one of the cylindrical support pipes (130) is adjusted in vertical and lateral directions, by a coupling bolt (B); and fastening belts (200) which are fastened to both sides of the bottom of the side support connection bar (180) by screws, and which fasten the side support connection bar (180) and the insertion/separation pipes (120) and the cylindrical support pipes (130) connected to the side support connection bar (180) by fastening a portion of a cushion part of a chair;

wherein rotating grips (190) are attached to the bottoms of the coupling bolts (B), respectively, by which the side support connection bar (180) connects and fastens the side fastening U-shaped plate supports (170), and the side support connection bar (180) is fastened to the bottom of a cushion part of a chair by using the two fastening belts (200) and coupling bolts (B') formed to be inserted into three bolt holes (P) formed in the side support connection bar (180).

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Embodiments of the present invention will be described in detail below with reference to the accompanying drawings.

Figure 1:
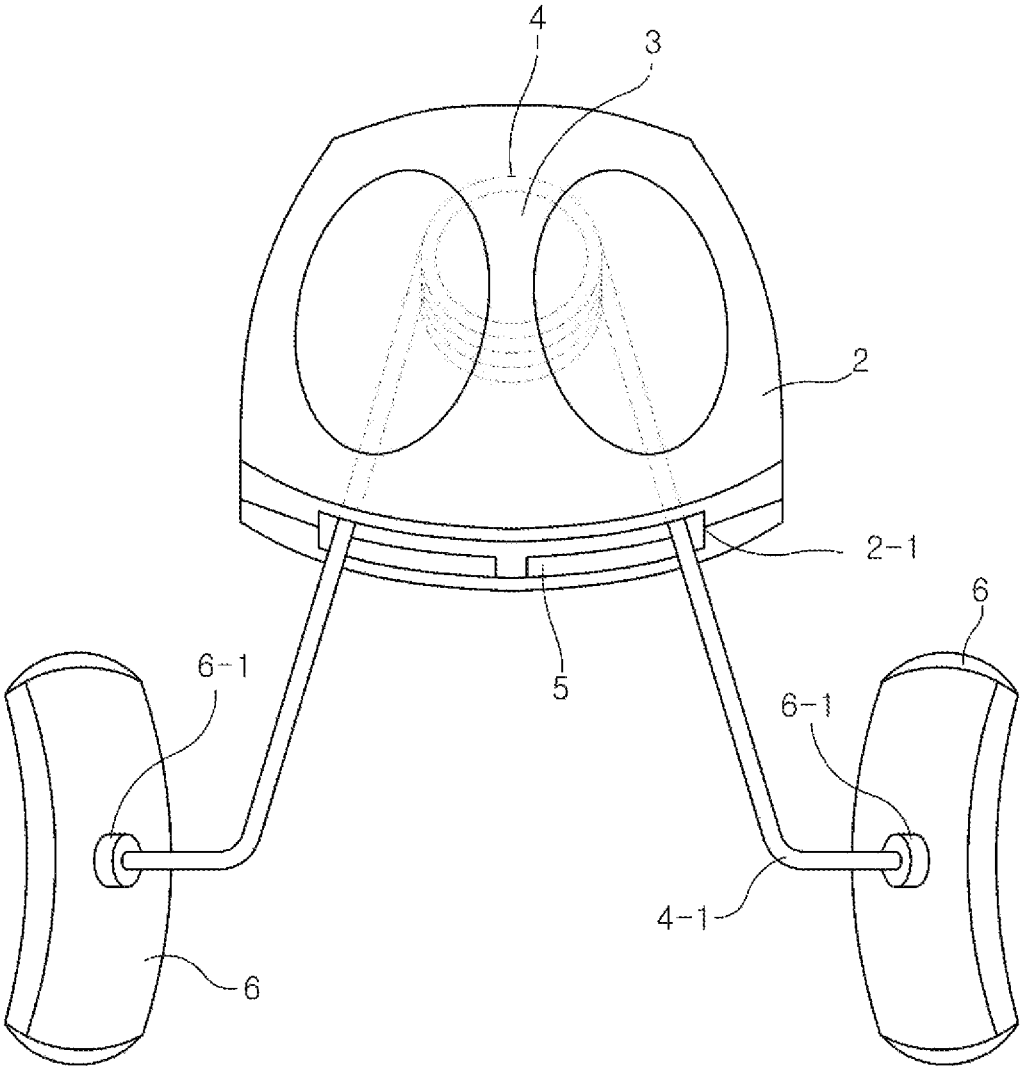
Prior Art FIG. 1
FIG. 1 is a schematic perspective view of conventional pelvic exercise equipment.
Figure 2:
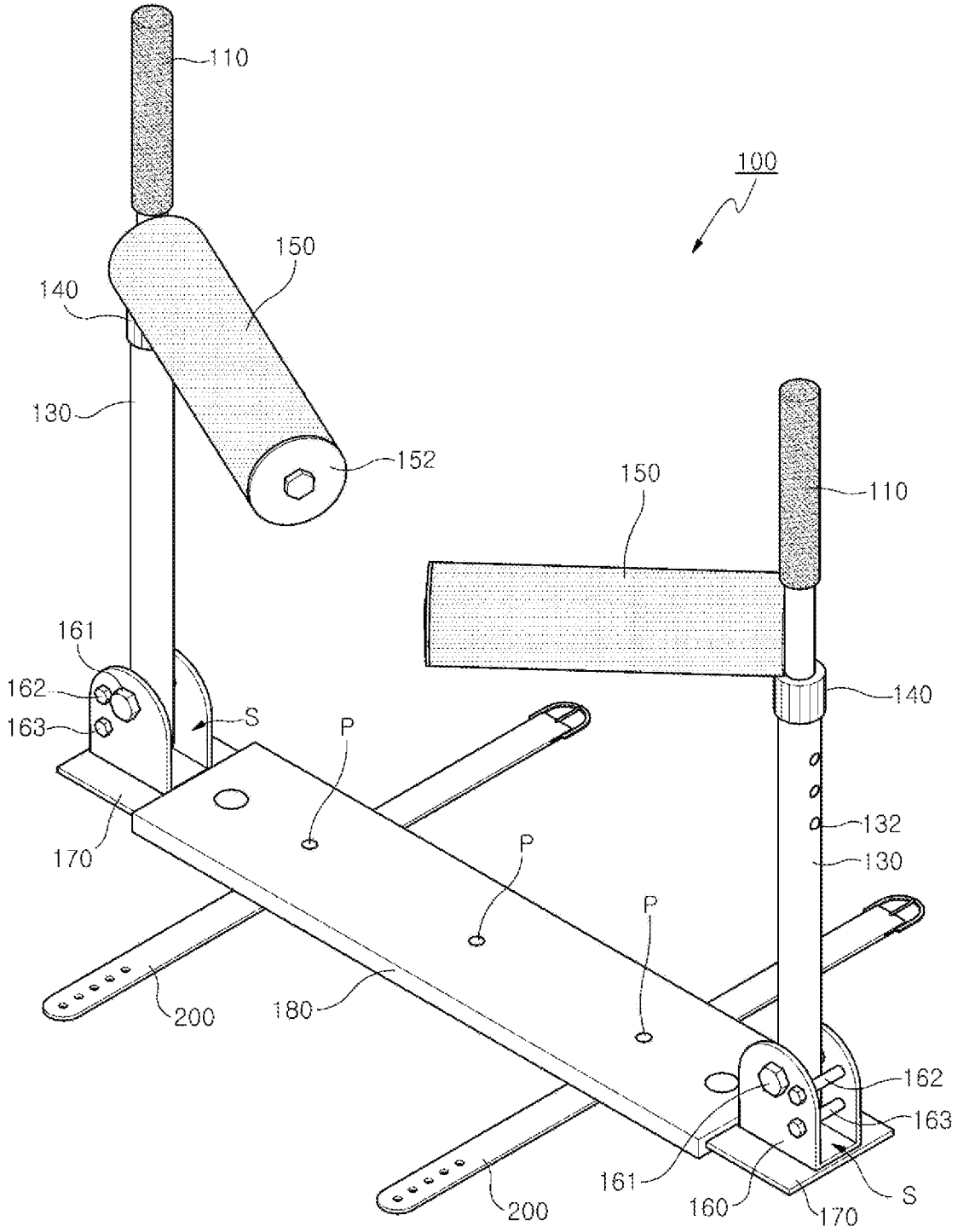
FIG. 2 is a schematic perspective view of exercise equipment for strengthening the pelvis according to the present invention.
Figure 3:
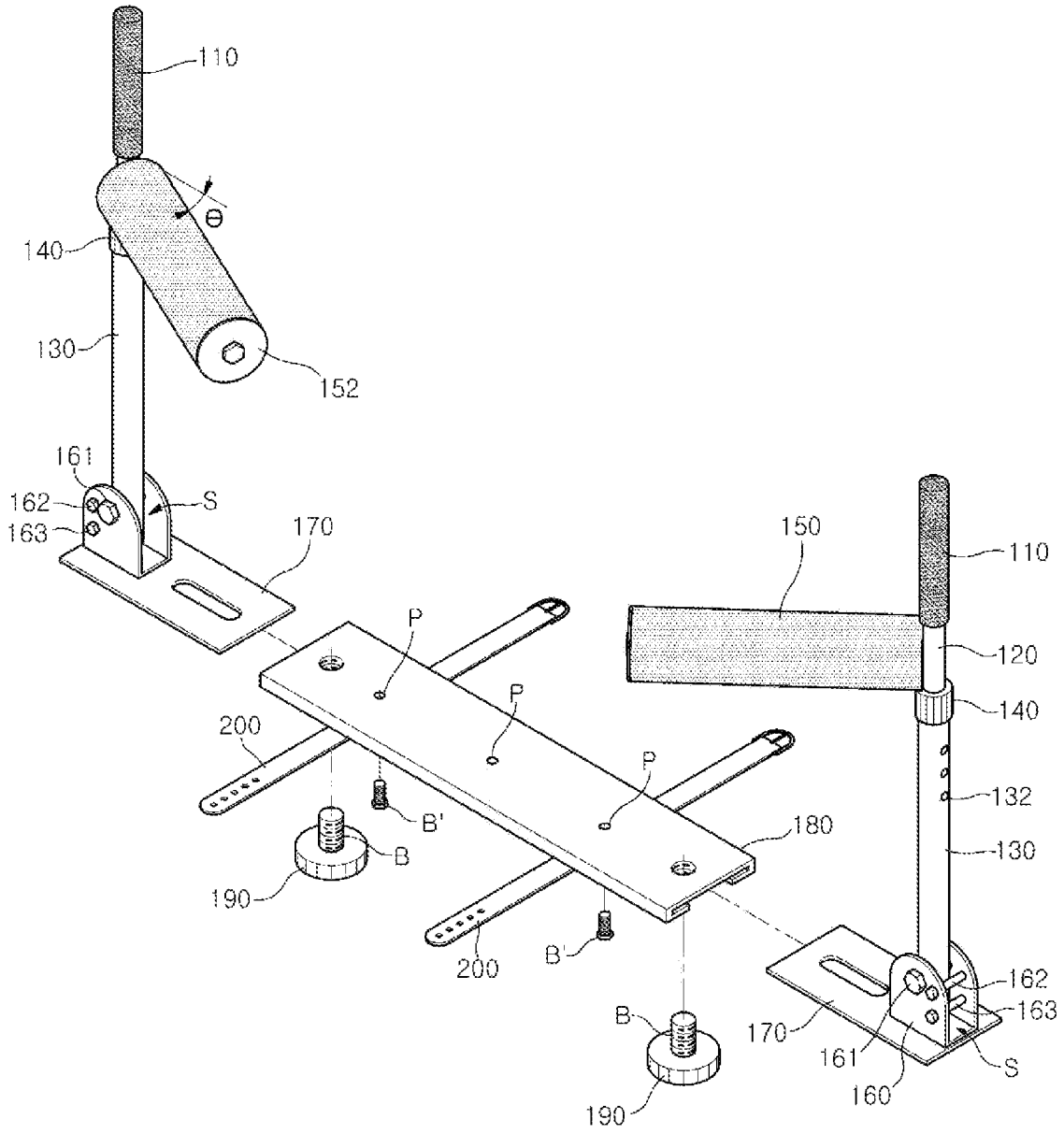
FIG. 3 is a schematic exploded perspective view of the exercise equipment for strengthening the pelvis according to the present invention.
Figure 4:
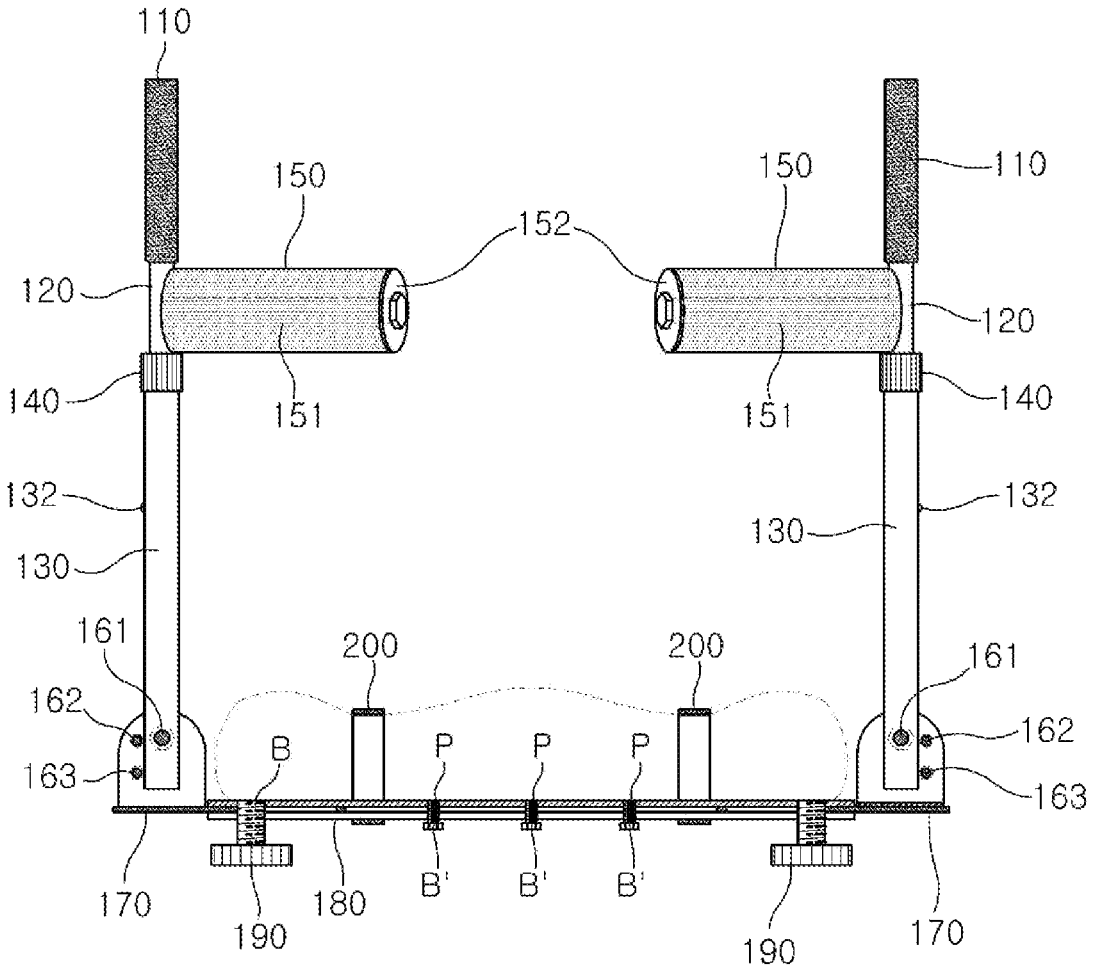
FIG. 4 is a front view of the exercise equipment for strengthening the pelvis according to the present invention.
Figure 5:
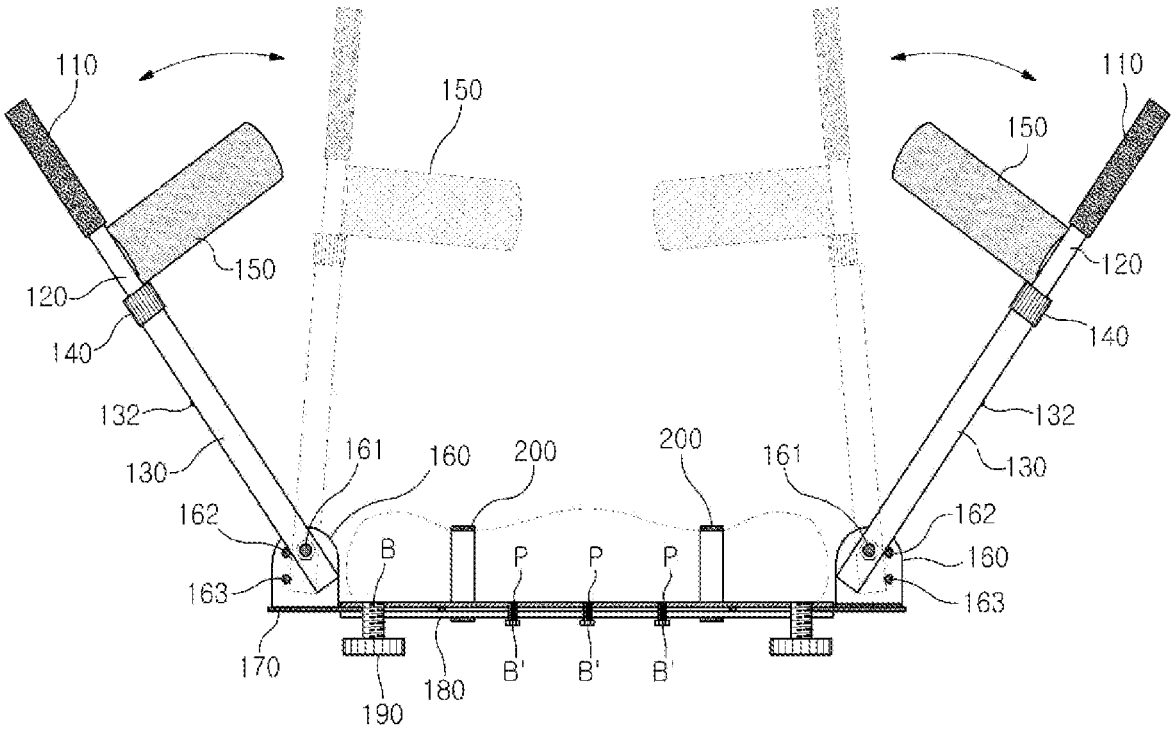
FIG. 5 is a view showing the operation of the exercise equipment for strengthening the pelvis according to the present invention.

FIG. 2 is a schematic perspective view of exercise equipment 100 for strengthening the pelvis according to the present invention, FIG. 3 is a schematic exploded perspective view of the exercise equipment 100 for strengthening the pelvis according to the present invention, FIG. 4 is a front view of the exercise equipment 100 for strengthening the pelvis according to the present invention, and FIG. 5 is a view showing the operation of the exercise equipment 100 for strengthening the pelvis according to the present invention.

In the exercise equipment 100 for strengthening the pelvis according to the present invention, grip parts 110 are provided in the top portions of the exercise equipment 100, and cylindrical support pipes 130, in each of which a cylindrical space is formed therein, are provided such that cylindrical insertion/separation pipes 120 connected to and extended downward from the respective grip parts 110 are inserted into and separated from the cylindrical support pipes 130, respectively.

In this case, a plurality of holes is vertically formed in one side of each of the cylindrical support pipes 130 so that protrusions 132, which elastically protrude from one side of a corresponding one of the insertion/separation pipes 120, are selectively fitted and fastened into the holes.

Furthermore, a packing part 140 is located along the axis of the support pipe 130 so that the support pipe 130 comes into tight contact with and is fastened to the insertion/separation pipe 120, a support shaft 151 inclined forward at a predetermined angle θ is connected to one side of the cylindrical insertion/separation pipe 120 below the grip part 110, a cushion support plate 152 is attached to one end of the support shaft 151, and a cylindrical cushion part 150 is disposed around the support shaft 151 so that a leg of an exercising person is located and rotated thereon.

Furthermore, a space is formed inside each of side fastening U-shaped plates 160 in which a support shaft 161, to which the lower end of a corresponding one of the cylindrical support pipes 130 is coupled, and upper and lower stop shafts 162 and 163, which are installed across upper and lower sides behind a corresponding one of the support shafts 161, are formed so that the angle of the cylindrical support pipe 130 is adjusted in vertical and lateral directions by using the support shaft 161 between the upper and lower stop shafts 162 and 163, and the lower end of the side fastening U-shaped plate 160 is installed on a fastening plate support 170.

In addition, an end of the fastening plate support 170, on which the side fastening U-shaped plate 160 is installed, is coupled and fastened to one side of a side support connection bar 180 by means of a coupling bolt B, the side support connection bar 180 is laterally extended in a horizontal direction, and an end of the other fastening plate support 170, on which the other side fastening U-shaped plate 160 that enables the angle of the cylindrical support pipe 130 to be adjusted in vertical and lateral direction, is coupled and fastened to the other side of the side support connection bar 180 by means of a coupling bolt B. Fastening belts 200 are installed on both sides of the bottom surface of the side support connection bar 180, the side support connection bar 180 and the insertion/separation pipes 120 and the cylindrical support pipes 130 connected to the side support connection bar 180 are fastened by fastening the side support connection bar 180 to the bottom of the cushion part of a chair by means of the two fastening belts 200 and coupling bolts B' configured to be screwed into three bolt holes P formed in the side support connection bar 180, and rotating grips 190 are attached to the bottoms of the coupling bolts B.

The operation and effect of the exercise equipment 100 for strengthening the pelvis according to the present invention, which is configured as described above, will be described below.

As shown in FIGS. 2 to 5, the exercise equipment for strengthening the pelvis according to the present invention enables an exercising person to perform the exercise of collecting and spreading his or her knees, thereby obtaining the exercise effect of enabling the pelvis, the genitourinary sphincter inside the pelvic cavity, etc. to be strongly contracted and relaxed. The exercise equipment 100 for strengthening the pelvis enables the exercise of collecting and spreading both knees to be performed during the movement of the cylindrical support pipes 130, coupled to the cylindrical insertion/separation pipes 120, within the spaces of the side fastening U-shaped plates 160 in vertical and lateral directions through the simple operation of moving the legs in vertical and lateral directions in a state in which an exercising person has placed his or her legs on the respective cylindrical cushion parts 150, inclined forward at a predetermined angle θ, for example, 30 degrees, and rotatably installed around the support shafts 151 while holding the grip parts 110 provided above the cylindrical insertion/separation pipes 120 with his or her hands.

In this case, the cylindrical insertion/separation pipes 120 connected to and extended downward from the grip parts 110 may be inserted into and separated from the inner cylindrical spaces of the cylindrical support pipes 130, in which case the plurality of holes is formed in one side of each of the cylindrical support pipes 130 and thus the protrusions 132 configured to elastically protrude from one side of a corresponding one of the insertion/separation pipes 120 are selectively fitted and fastened into the holes.

Accordingly, the heights of the insertion/separation pipes 120, on which the cylindrical cushion parts 150 are installed, may be easily adjusted in accordance with the lengths of the legs of an exercising person. Furthermore, in a state in which the lower ends of the cylindrical support pipes 130 have been coupled to the support shafts 161 installed across the respective side fastening U-shaped plates 160, the angles of the cylindrical support pipes 130 may be adjusted using the shafts 161 in vertical and lateral directions within the spaces between the upper and lower stop shafts 162 and 163 installed across upper and lower sides behind the support shafts 161.

The bottoms of the side fastening U-shaped plates 160 are installed on the fastening plate supports 170, and thus an exercising person may perform the exercise of collecting and spreading both knees in a comfortable state in which both legs have been spread at a predetermined angle.

In addition, one side of the side support connection bar 180 is coupled and fastened to an end portion of a corresponding one of the fastening plate supports 170, on which one of the side fastening U-shaped plates 160 is installed, by means of the coupling bolt B, the side support connection bar 180 is laterally installed in a horizontal direction, and an end of the other fastening plate support 170, on which the other side fastening U-shaped plate 160 is installed in order to enable the angle of the cylindrical support pipe 130 to be adjusted in vertical and lateral directions, is coupled and fastened to the other side of the side support connection bar 180 by means of the coupling bolt B. Accordingly, the assembly and disassembly of the exercise equipment 100 for strengthening the pelvis that is divided into left and right parts may be easily performed, and also the carrying and storage of the exercise equipment 100 for strengthening the pelvis may be conveniently and easily performed.

Furthermore, the side support connection bar 180 and the insertion/separation pipes 120 and the cylindrical support pipes 130 connected to the side support connection bar 180 are fastened by the operation of fastening them to the bottom of the cushion part of a chair by using the fastening belts 200 installed on the two sides of the bottom surface of the side support connection bar 180 and the three coupling bolts B,' and the side support connection bar 180 of the exercise equipment 100 for strengthening the pelvis, which is divided into left and right parts, is installed and used on the front portion of the bottom of the cushion part a chair in a home or office via the rotating grips 190 attached to the bottoms of the coupling bolts B.

Via the exercise equipment for strengthening the pelvis according to the embodiment of the present invention, the exercise effect of enabling the pelvis, the genitourinary sphincter inside the pelvic cavity, etc. to be strongly contacted and relaxed may be obtained through the simple operation of moving the knees of both legs in vertical and lateral directions in a state in which an exercising person has placed his or her legs on the respective cylindrical cushion parts installed on respective sides below the grip parts while holding the grip parts provided above the cylindrical insertion/separation pipes during the exercise of collecting and spreading the knees, the heights of the respective insertion/separation pipes on which the cylindrical cushion parts are installed may be easily and conveniently adjusted in accordance with the lengths of the legs of the exercising person, the cylindrical cushion parts on which the legs of a human body are placed are inclined forward at a predetermined angle so that the exercising person may perform the exercise of collecting and spreading the knees in a comfortable state in which the legs have been spread at a predetermined angle, and the exercise equipment for strengthening the pelvis is divided into left and right parts so that the assembly and disassembly of the exercise equipment may be easily performed, so that the carrying and storage of the exercise equipment may be conveniently and easily performed, and so that the exercise equipment may be conveniently installed and used on the cushion part of a chair in a home or office by using the fastening belts.

Although the specific embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. An exercise equipment for strengthening a pelvis, the exercise equipment comprising:

left and right grip parts which are provided in top portions of the exercise equipment;

left and right cylindrical insertion/separation pipes which are connected to and extended downward from the left and right grip parts, respectively;

left and right cylindrical support pipes in which respective cylindrical spaces are formed so that the left and right cylindrical insertion/separation pipes are inserted thereto and separated therefrom, respectively, and each cylindrical support pipe is provided with a plurality of holes on one side thereof so that protrusions, which elastically protrude from one side of each of the left and right insertion/separation pipes, are selectively coupled and fastened into the holes and thus enable vertical adjustment of a length;

left and right cylindrical cushion parts rotatably installed around left and right support shafts, respectively, the left and right support shafts being mounted and inclined forward at a predetermined angle θ on one side of the left and right cylindrical insertion/separation pipes, respectively, and left and right cushion support plates being attached to one side end of the left and right support shafts, respectively, wherein the left and right cylindrical cushion parts are configured so that legs of an exercising person are located and rotated thereon;

left and right side fastening U-shaped plates in each of which a second support shaft, to which a corresponding one of the left and right cylindrical support pipes is coupled, and upper and lower stop shafts, which are installed across upper and lower sides of a corresponding one of the left and right side fastening U-shaped plates, respectively, are formed, and in each of which a space, within which an angle of the corresponding cylindrical support pipe is adjusted between the upper and lower stop shafts around the second support shaft in vertical and lateral directions, is formed;

left and right fastening plate supports wherein bottom ends of the left and right side fastening U-shaped plates are installed on a left end portion of the left fastening plate support and a right end portion of the right fastening plate support, respectively;

a side support connection bar laterally extended by a predetermined length in a horizontal direction wherein a left end portion of the side support connection bar is coupled and fastened to a right end portion of the left fastening plate support by a left coupling bolt; and a right end portion of the side support connection bar is coupled and fastened to a left end portion of the right fastening plate support by a right coupling bolt; and left and right fastening belts which are fastened to left and right sides of a bottom of the side support connection bar by screws, respectively, and which fasten the side support connection bar to a cushion part of a chair such that the side support connection bar is fastened to a bottom of the cushion part of the chair;

wherein left and right rotating grips are attached to bottoms of the left and right coupling bolts, respectively.

* * * * *